US010962203B1

(12) United States Patent
Steines et al.

(10) Patent No.: US 10,962,203 B1
(45) Date of Patent: Mar. 30, 2021

(54) ADJUSTABLE LIGHT FIXTURE

(71) Applicant: Electronic Theatre Controls, Inc., Middleton, WI (US)

(72) Inventors: Jay Steines, Middleton, WI (US); Jon Rasche, Middleton, WI (US); Zack Zlevor, Middleton, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 16/834,054

(22) Filed: Mar. 30, 2020

(51) Int. Cl.

| | |
|---|---|
| ***F21V 15/00*** | (2015.01) |
| ***F21V 29/70*** | (2015.01) |
| ***F21V 17/12*** | (2006.01) |
| ***F21S 8/02*** | (2006.01) |

(52) U.S. Cl.
CPC ..... *F21V 17/12* (2013.01); *F21S 8/026* (2013.01)

(58) Field of Classification Search
CPC ..... F21V 17/12; F21S 8/026
See application file for complete search history.

(56) References Cited

U.S. PATENT DOCUMENTS

| | | | | |
|---|---|---|---|---|
| 2,855,503 | A | 10/1958 | Gerstel | |
| 4,623,956 | A | 11/1986 | Conti | |
| 5,562,343 | A | 10/1996 | Chan et al. | |
| 7,303,314 | B2 | 12/2007 | Jones | |
| 7,322,722 | B2 * | 1/2008 | Hartmann, Jr. | F21S 8/02 362/365 |
| 7,484,866 | B1 * | 2/2009 | Buse | F21S 8/02 362/147 |
| 7,530,705 | B2 | 5/2009 | Czech et al. | |
| 7,559,677 | B1 * | 7/2009 | Dupre | F21S 8/02 362/287 |
| 8,182,116 | B2 | 5/2012 | Zhang et al. | |
| 8,215,805 | B2 | 7/2012 | Cogliano et al. | |
| 8,226,278 | B2 | 7/2012 | Ward et al. | |
| 8,245,993 | B2 * | 8/2012 | Arnold | H02G 3/20 248/343 |
| 8,545,063 | B2 * | 10/2013 | Dupuy | F21V 21/04 362/368 |
| 9,134,016 | B2 | 9/2015 | David et al. | |
| 9,239,149 | B2 | 1/2016 | Vice et al. | |
| 9,383,087 | B2 * | 7/2016 | Rashidi Doust | F21V 29/70 |
| 9,429,284 | B2 | 8/2016 | Park et al. | |
| 9,523,490 | B2 | 12/2016 | Kathawate et al. | |
| 9,964,293 | B2 | 5/2018 | Devlin | |
| 9,970,636 | B1 | 5/2018 | Winters | |
| 10,168,035 | B2 | 1/2019 | Bardot | |
| 10,317,054 | B1 | 6/2019 | Davis et al. | |
| 2013/0322084 | A1 | 12/2013 | Ebisawa | |
| 2017/0234517 | A1 | 8/2017 | Highbridge | |
| 2018/0073705 | A1 * | 3/2018 | Delano | F21V 7/00 |
| 2019/0271456 | A1 | 9/2019 | Hierzer | |

* cited by examiner

*Primary Examiner* — Tracie Y Green
(74) *Attorney, Agent, or Firm* — Michael Best and Friedrich LLP

(57) ABSTRACT

A light fixture including a light source having an optical axis and a housing having an inner housing and an outer housing. The outer housing pivots on the inner housing and the light source is coupled to the outer housing for pivotal movement with the outer housing relative to the inner housing to move the optical axis relative to the inner housing. A retainer coupled to the housing and a portion of the retainer is movable in a direction toward the outer housing to inhibit movement of the outer housing relative to the inner housing to hold a position of the optical axis.

20 Claims, 6 Drawing Sheets

ADJUSTABLE LIGHT FIXTURE

BACKGROUND

The present invention relates to light fixtures and more particular to light fixtures where the light source of the light fixture is movable or adjustable to direct the optical axis of the light source in different directions.

SUMMARY

In one embodiment, the invention provides a light fixture including a light source having an optical axis and a housing. The light source is coupled to the housing for movement with the housing. The housing includes a longitudinal axis and a housing outer dimension measured perpendicular to the longitudinal axis. The housing is configured to be received in an aperture of a ceiling. A flange extends from the housing and the flange has a flange outer dimension that is greater than the housing outer dimension. The housing is coupled to the flange such that the housing is movable relative to the flange to move the optical axis of the light source. A retainer surrounds the housing and a portion of the retainer is movable in a direction toward the housing and the flange to inhibit movement of the housing relative to the flange to hold a position of the optical axis.

In another embodiment, the invention provides a light fixture including a light source having an optical axis and a housing having an inner housing and an outer housing. The outer housing pivots on the inner housing and the light source is coupled to the outer housing for pivotal movement with the outer housing relative to the inner housing to move the optical axis relative to the inner housing. A retainer coupled to the housing and a portion of the retainer is movable in a direction toward the outer housing to inhibit movement of the outer housing relative to the inner housing to hold a position of the optical axis.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
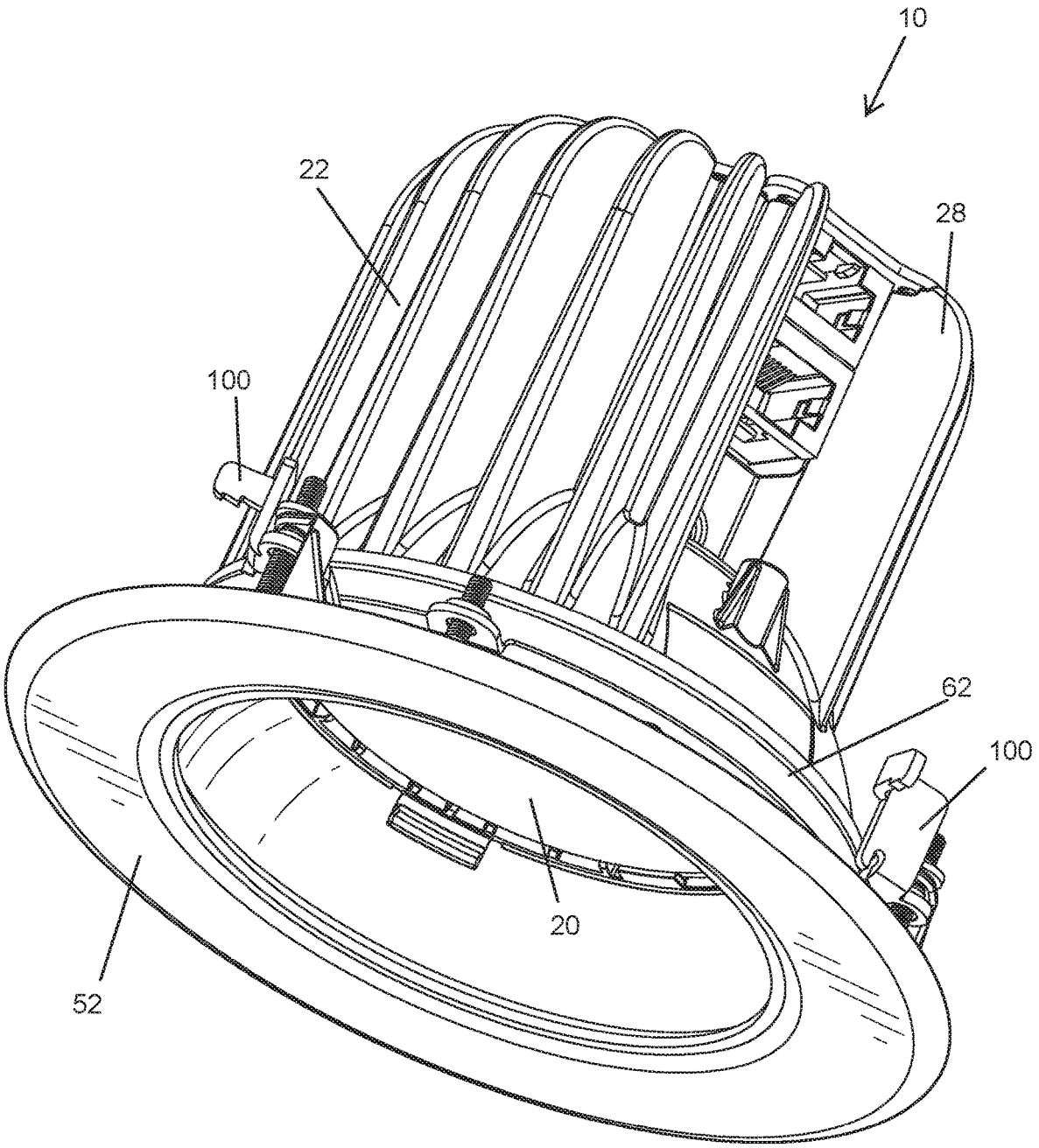
FIG. 1 is a perspective view of a light fixture according to one embodiment of the invention.

FIG. 1 illustrates a light fixture 10. The light fixture 10 is particularly suited for being mounted to or in a ceiling. For example, referring to FIG. 4, the light source 10 is mounted to a ceiling 12. The ceiling 12 includes an aperture 14 and the light fixture 10 extends through the aperture 14. The ceiling 12 includes a first or front side 16 and a second or back side 18. The front side 16 generally faces a floor and the back side 18 faces in the opposite direction generally toward the ceiling or support structure of a building. In the illustrated embodiment, the light fixture 10 is mounted to the ceiling 12 so that the light fixture 10 extends through the aperture 14 and the light fixture 10 is generally flush with the front side 16 of the ceiling. Mounting the light fixture 10 to the ceiling 12 and positioning the light fixture 10 relative to the ceiling 12 will be discussed in more detail below.

Figure 4:
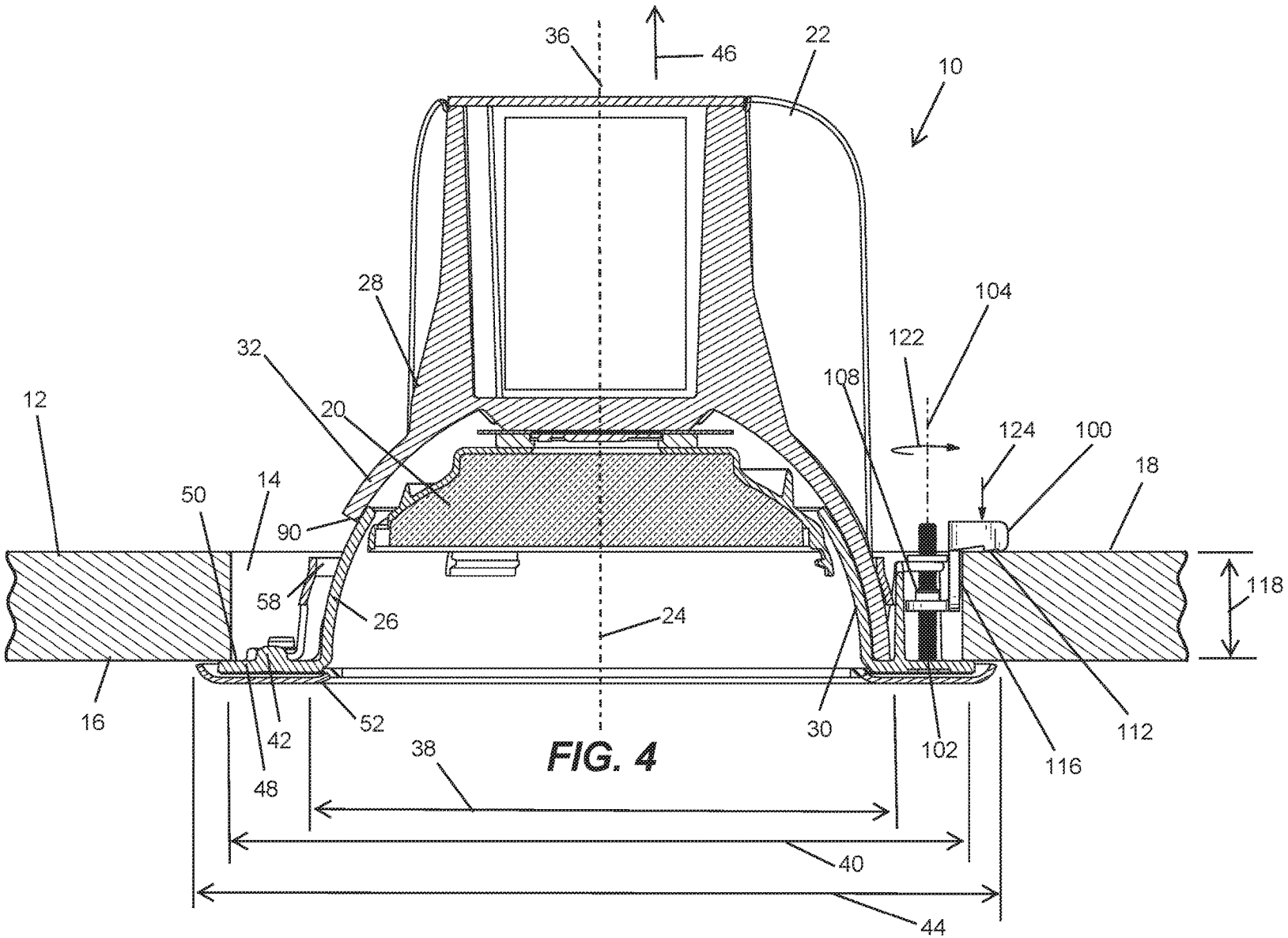
FIG. 4 is a cross-sectional view taken along lines 4-4 of FIG. 2 illustrating a clamping in a first position with a ceiling having a first thickness.
Figure 5:
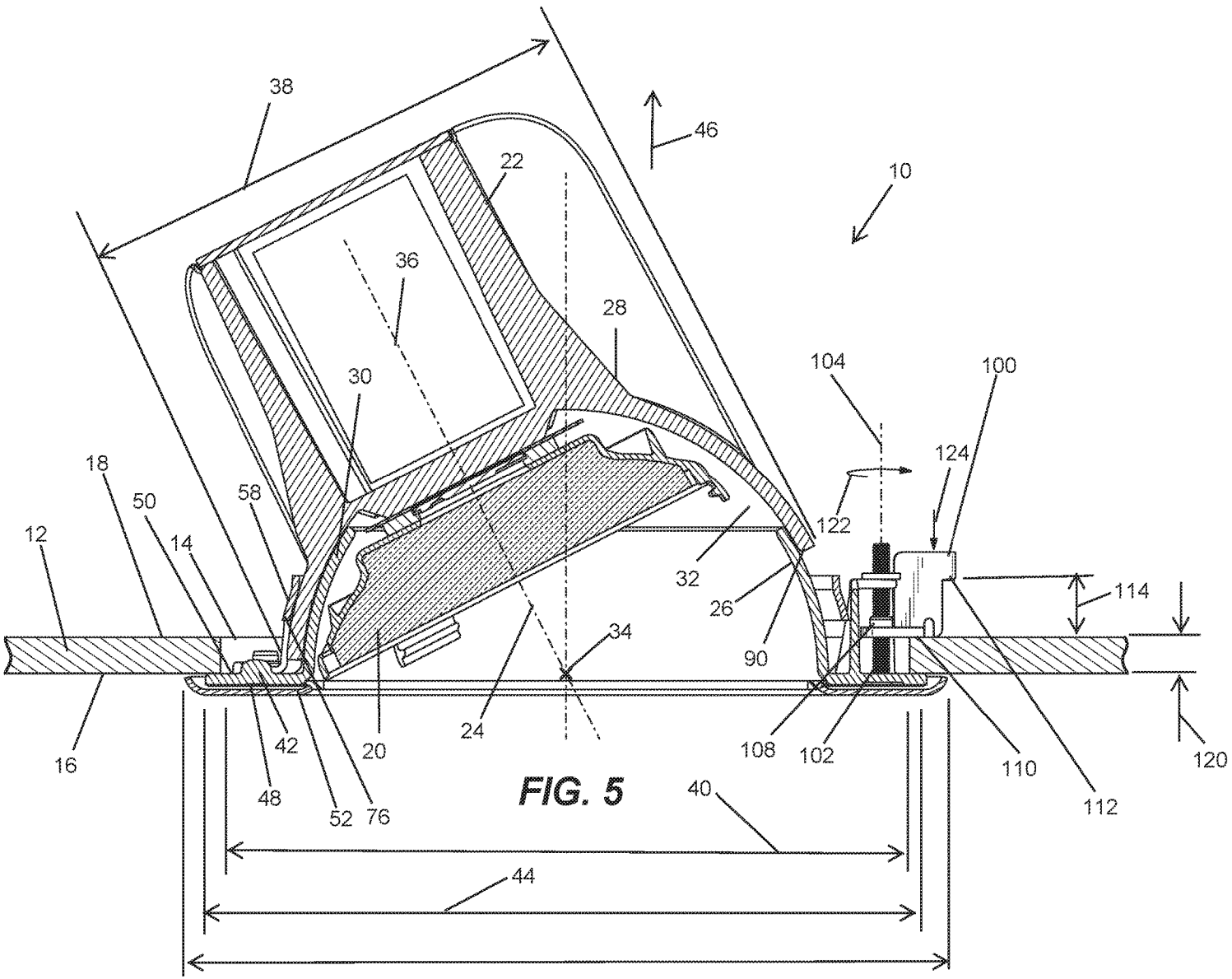
FIG. 5 is a cross-sectional view similar to FIG. 4 but showing the clamping in a second position with a ceiling having a second thickness and a housing and light source angled relative to the ceiling.

With continued reference to FIG. 4, the light fixture 10 includes a light source 20 and a housing 22. The light source 20 has an optical axis 24. The light source 20 can include any suitable types of light sources, including light emitting diodes, incandescent, fluorescent, and the like. In one embodiment, the light source 20 is a bulb that is removably coupled to the housing 22. The housing 22 includes an inner housing 26 and an outer housing 28 that pivots on the inner housing 26 as shown in FIG. 5, which allows the user to direct the light source 20 or optical axis 24 in different directions. In the illustrated embodiment, the inner housing 26 includes a generally spherical portion 30 and the outer housing 28 includes a corresponding spherical portion 32 that allows the outer housing 28 to pivot relative to the inner housing 26 about a pivot point 34. The light source 20 is coupled to the outer housing 28 for movement with the outer housing 28 relative to the inner housing 26.

With continued reference to FIGS. 4 and 5, the outer housing 28 includes a longitudinal axis 36. The longitudinal axis 36 is coaxial with the optical axis 24 and extends through the pivot point 34 in the illustrated embodiment. The outer housing 28 has an outer dimension 38 measured perpendicular to the longitudinal axis 36. The outer dimension 38 of the housing 28 is less than a dimension 40 of the ceiling aperture 14 so that the light fixture 10 can be inserted through the aperture 14.

The light fixture 10 further includes a flange 42 that extends from the inner housing 26. The illustrated flange 42 is fixed to the inner housing 26 so that the outer housing 28 is movable relative to the flange 42 and the inner housing 26. The flange 42 has an outer dimension 44 measure as shown in FIG. 4. The outer dimension 44 of the flange 42 is greater than the outer dimension 38 of the outer housing 28 and greater than the aperture 14 of the ceiling 12. Therefore, the flange 42 contacts the front side 16 of the ceiling 12 to inhibit further movement of the light fixture 10 through the aperture 14 in the direction of arrow 46 in FIGS. 4 and 5. The flange 42 has a first side 48 that faces away from the housing 22 and a second side 50 opposite the first side 48. The first side 48 faces the floor and the second side 50 contacts the front side 16 of the ceiling 12 when the light fixture is installed as shown in FIG. 4. A trim 52, which may be a decorative trim, is attached to the first side 48 of the flange 42 in the illustrated embodiment. In the illustrated embodiment, the trim 52 is removably coupled to the flange 42 using a snap fit or the like.

Figure 2:
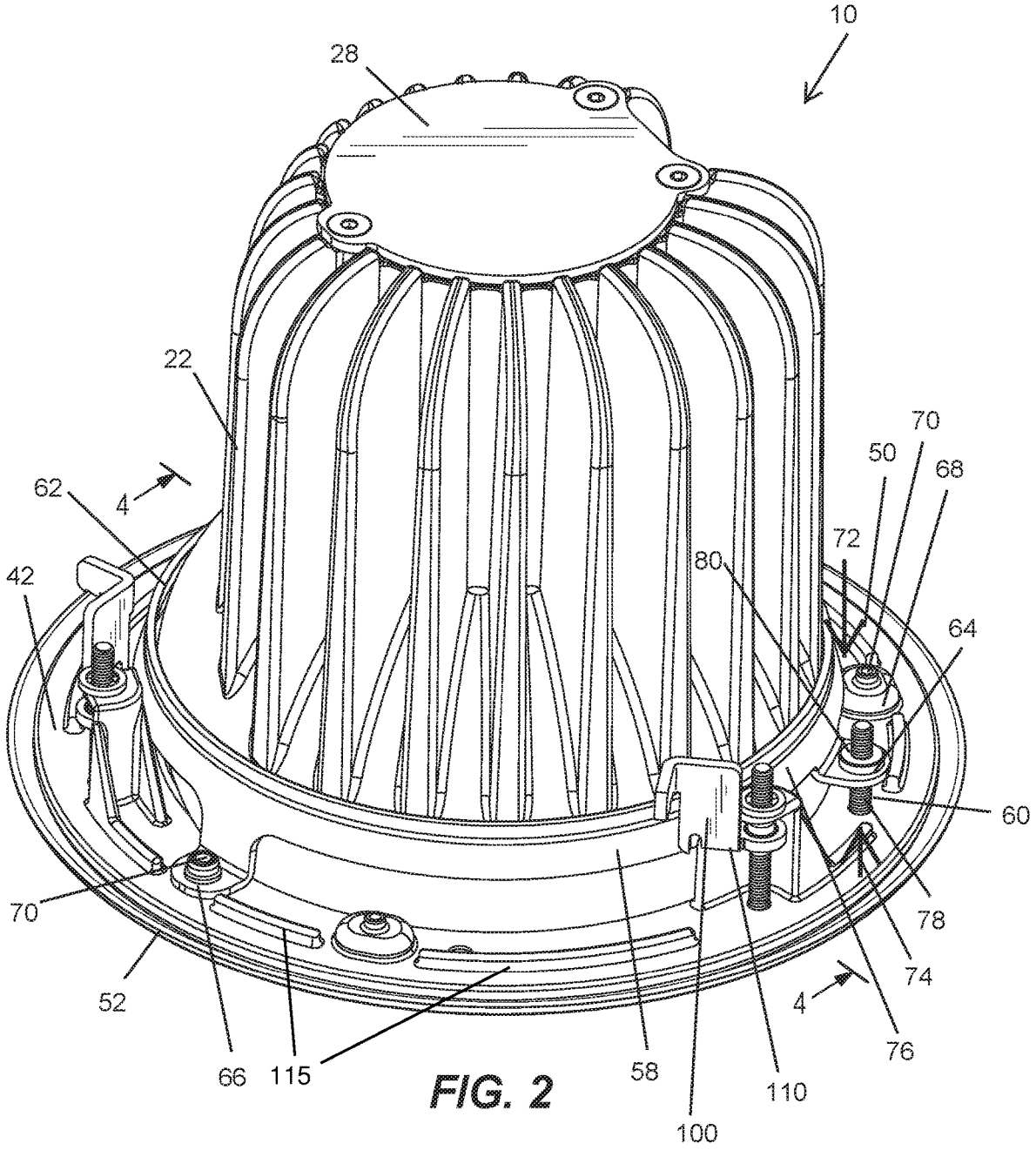
FIG. 2 is an alternative perspective view of the light fixture of FIG. 1.
Figure 3:
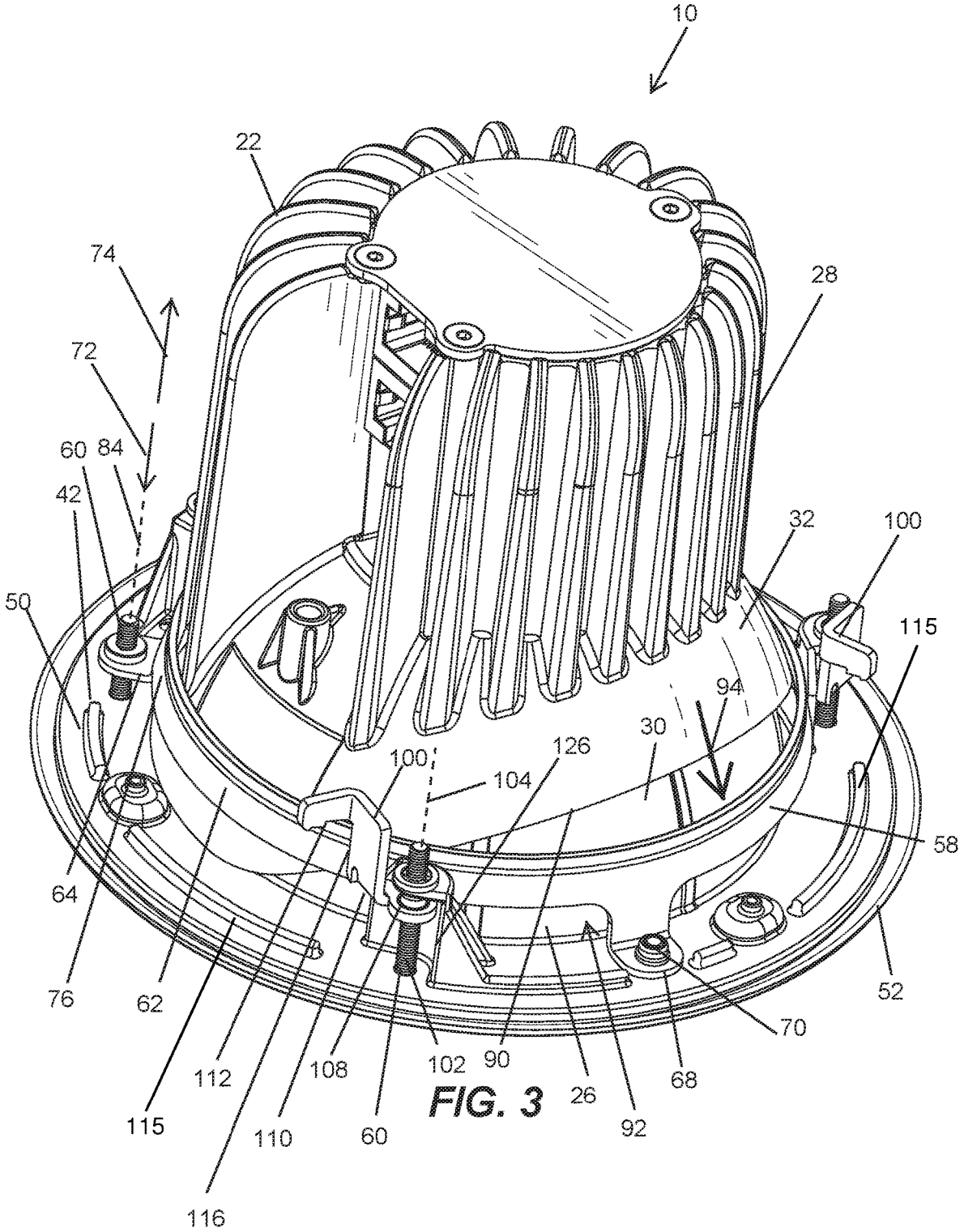
FIG. 3 is an alternative perspective view of the light fixture of FIG. 1.

Referring to FIGS. 2 and 3, the light fixture 10 further includes a retainer 58 and an actuator 60 for the retainer 58. The retainer 58 holds a desired position of the outer housing 28 relative to the inner housing 26 and the flange 42 so that the user can direct the light source 20 as desired and hold the desired position. The illustrated retainer 58 includes a ring 62 and legs 64, 66, 68. The ring 62 surrounds the outer housing 28 such that the longitudinal axis 36 of the outer housing 28 extends through the ring 62. The ring 62 is also concentric with the flange 42. The legs 66, 68 extend from the ring 62 to the flange 42. The legs 66, 68 are fixed from movement relative to the flange 42 and the housing 22 by fasteners 70. The leg 64 is movable generally in the direction of arrows 72, 74 either toward the flange 42 and the outer housing 28 or away from the flange 42 and the outer housing 28.

The actuator 60 moves a portion 76 of the retainer 58 in the direction of arrows 72, 74. In the illustrated embodiment, the actuator 60 includes a fastener, particularly a screw 78. The screw 78 extends through the leg 64, which includes a thread aperture 80. The screw 78 includes a head 82 (FIG. 6) that is accessible from the first side 48 of the flange 42. The head 82 is rotated to rotate the screw 78 about an axis 84 (FIG. 3), which causes the portion 76 of the retainer 58 to move generally in the direction of arrows 72, 74 with the leg 64.

In operation, the user moves or pivots the outer housing 28 on the inner housing 26 to direct the optical axis 24 and the light source 20 in the desired direction relative to the ceiling 12, a wall, a floor, or another object. Two possible positions are shown in FIGS. 4 and 5. Then, with the trim removed, the user rotates the screw head 82 in the direction of arrow 86 in FIG. 6 to rotate the screw 78 about the axis 84 (FIG. 3). This rotation moves the leg 64 and the portion 76 of the ring 62 in the direction of arrow 72 down toward the outer housing 28. The ring 62, particular the portion 76 produces a clamping type pressure and enough friction on the outer housing 28 to hold the outer housing 28 and the optical axis 24 in the desired position. The trim 52 is then reattached to the flange 42 to conceal the screw head 82. To reposition the light source 20 and the optical axis 24, the user removes the trim 52 and rotates the screw head 82 in the direction of arrow 88 in FIG. 6. This releases the clamping pressure and friction by the ring 62 on the outer housing 28, which allows the user to move the outer housing 28 and the light source 20. The screw head 82 is then rotated in the direction of arrow 86 to hold the light source 20 in position. The trim 52 is reattached to the flange 42. Therefore, in the illustrated embodiment, the user only needs to adjust or actuate only a single fastener or screw 78 to reposition the light source 20.

Referring to FIG. 3, the outer housing 28 further includes a portion 90 that has material removed or that defines a gap 92 between the outer housing 28 and the flange 42. This allows the user to pivot the outer housing 28 in the direction of arrow 94 in FIG. 3 toward the flange 42 to the position shown in FIG. 5 and no portion of the outer housing 28 extends below the ceiling 12. If the gap 92 did not exist and the outer housing 28 was symmetric with the opposite side from the gap 92, when the outer housing 28 is in the position shown in FIG. 5, a portion of the outer housing 28 would extend below the side 16 of the ceiling 12.

Referring to FIGS. 2 and 3, the light fixture 10 further includes clamps 100 and clamp fasteners 102 that attach the light fixture 10 to the ceiling 12 and hold the position of the light fixture 10 relative to the ceiling 12. The illustrated light fixture 10 includes three clamps 100 and three corresponding clamp fasteners 102. In other embodiments, the light fixture 10 may include fewer than three or more than three clamps 100 and fasteners 102. The illustrated clamps 100 and fasteners 102 are the same and therefore only one of the clamps 100 and fasteners 102 will be described in detail.

Figure 6:
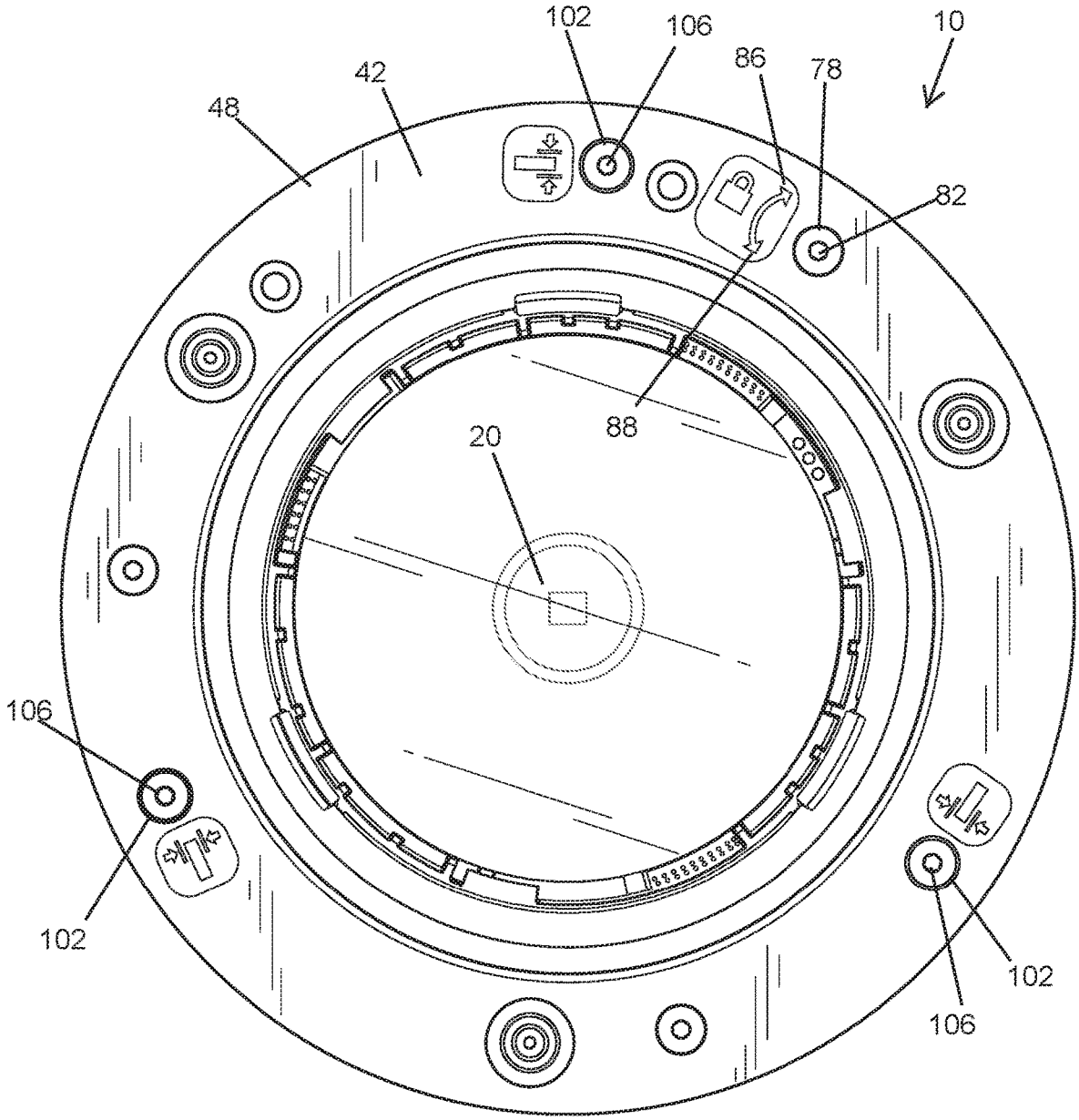
FIG. 6 is an end view of the light fixture of FIG. 1 with a trim removed.

The clamp fastener 102 is rotatable about a clamp fastener axis 104. The axis 104 extends from the flange 42 generally perpendicular to the flange 42. In the illustrated embodiment, the fastener 102 is a screw having a head 106 (FIG. 6). The head 106 is accessible from the first side 48 of the flange 42 when the trim 52 is removed and the trim 52 conceals the heads 106 of the fasteners 100 when the trim 52 is attached to the flange 42.

Referring to FIG. 3, the clamp 100 includes a clamp aperture 108 and the screw 102 extends through the aperture 108, which is threaded in the illustrated embodiment. The clamp 100 further includes a first clamp surface 110 and a second clamp surface 112. The clamp surfaces 110, 112 are generally parallel and spaced and an offset distance 114. The offset distance 114 is measure parallel to the axis 104 as shown in FIG. 5. In one embodiment, the offset distance 114 is in a range from about 0.250 inches to 2 inches. In the illustrated embodiment, the offset distance is about 0.4 inches. A stop surface 116 extend from the first clamp surface 110 to the second clamp surface 112 perpendicular to the clamp surfaces 110, 112. The first clamp surface 110 is also angularly offset from the second clamp surface 112. In the illustrated embodiment, the first clamp surface 110 is about perpendicular to the second clamp surface 112 relative to the stop surface 116. As will be discussed below, the clamp surfaces 110, 112 facilitate attaching the light fixture 10 to ceilings 12 having different thicknesses 118, 120 (FIGS. 4 and 5)

Referring to FIGS. 3, 4, and 6, attaching the light fixture 10 to the ceiling 12 having a relatively thick thickness 118 will be discussed. First, the clamps 100 are all rotated to the positions shown in FIGS. 2 and 3 so that the clamps 100 are within the flange 42 and do not extend beyond the flange 42. Then, the light fixture 10 is inserted through the aperture 14 in the direction of arrow 46 until the flange 42 contacts the front side 16 of the ceiling 12. With the trim 52 removed, the user rotates the head 106 of the fastener 102 in the direction of arrow 122 to rotate the fastener 102 about the axis 104. This rotation causes the clamp 100 to rotate with the fastener 102 out away from the housing 22 and beyond the flange 42. Eventually, the stop surface 116 of the clamp 100 contacts the ceiling 12 as shown in FIG. 4 to stop rotation of the clamp 100 relative to the fastener 102. Continued rotation of the fastener 102 causes the clamp 100 to move in the direction of arrow 124 toward the back side 18 of the ceiling 12 and the second clamping surface 112 moves into contact with the back side 18 of the ceiling 12. The fastener 102 is rotated until a sufficient clamping force is applied by the clamping surface 112 to secure the ceiling 12 between the clamping surface 112 and the flange 42. The processes is repeated with the other clamps 100 and clamp fasteners 102 and the trim 52 is attached to the flange 42 to conceal the heads 106 of the clamp fasteners 102.

Referring to FIGS. 3 and 5, attaching the light fixture 10 to the ceiling 12 having a relatively thin thickness 120 (FIG. 5) will be discussed. First, the clamps 100 are all rotated to the positions shown in FIGS. 2 and 3 so that the clamps 100 are within the flange 42 and do not extend beyond the flange 42. In the illustrated embodiment, the clamp 100 are all rotated so that the clamps 100 are within a rib 115 that extends circumferentially around the flange 42. The rib 115 engages the front side 16 of the ceiling 12. Then, the light fixture 10 is inserted through the aperture 14 in the direction of arrow 46 until the flange 42 contacts the front side 16 of the ceiling 12. With the trim 52 removed, the user rotates the head 106 of the fastener 102 in the direction of arrow 122 to rotate the fastener 102 about the axis 104. This rotation causes the clamp 100 to rotate with the fastener 102 out away from the housing 22 and beyond the flange 42. Eventually, the clamp 100 contacts a portion 128 of the flange 42 or the housing 22 (FIG. 3) to stop rotation of the clamp 100 relative to the fastener 102. Continued rotation of the fastener 102 causes the clamp 100 to move in the direction of arrow 124 toward the back side 18 of the ceiling 12 and the first clamping surface 110 moves into contact with the back side of the ceiling 12. The fastener 100 is rotated until a sufficient clamping force is applied by the second clamping surface 110 to secure the ceiling 12 between the clamping surface 112 and the flange 42. The processes is repeated with the other clamps 100 and clamp fasteners 102 and the trim 52 is attached to the flange 42 to conceal the heads 106 of the clamp fasteners 102.

When the light fixture 10 is secured to the ceiling 12, the user may adjust the orientation of the optical axis 24 and the light source 20 as described above.

Although the invention has been described in detail with reference to certain preferred embodiments, variations and modifications exist within the scope and spirit of one or more independent aspects of the invention as described.

What is claimed is:

1. A light fixture comprising:

a light source having an optical axis;

a housing, the light source coupled to the housing for movement with the housing, the housing including a longitudinal axis and a housing outer dimension measured perpendicular to the longitudinal axis, the housing configured to be received in an aperture of a ceiling;

a flange that extends from the housing, the flange having a flange outer dimension that is greater than the housing outer dimension, the housing is coupled to the flange such that the housing is movable relative to the flange to move the optical axis of the light source;

a retainer that surrounds the housing, a portion of the retainer movable in a direction toward the housing and the flange to inhibit movement of the housing relative to the flange to hold a position of the optical axis.

2. The light fixture of claim 1, further comprising an actuator coupled to the retainer, wherein the actuator moves the retainer in the direction toward the housing and the flange to inhibit movement of the housing relative to the flange.

3. The light fixture of claim 2, wherein the actuator includes a fastener rotatable about a fastener axis to move the retainer in the direction toward the housing and the flange to inhibit movement of the housing relative to the flange.

4. The light fixture of claim 3, wherein the light fixture includes only a single fastener needed to move the retainer in the direction toward the housing and the flange to inhibit movement of the housing relative to the flange.

5. The light fixture of claim 3, wherein the flange has a first side that faces away from the housing and a second side opposite the first side, the second side faces toward the housing, wherein the fastener is accessible for rotation from the first side of the flange.

6. The light fixture of claim 5, further comprising a trim removably coupled to the first side of the flange to conceal the fastener.

7. The light fixture of claim 1, wherein the retainer includes a ring that surrounds the housing.

8. The light fixture of claim 7, wherein the ring and the flange are concentric.

9. The light fixture of claim 1, wherein the retainer includes a ring, a first leg that extends from the ring, and a second leg that extends from the ring, wherein the first leg is fixed from movement relative to the flange and the second leg is moveable relative to the flange to move the portion of the retainer that is movable in the direction toward the housing and the flange to inhibit movement of the housing relative to the flange to hold the position of the optical axis.

10. The light fixture of claim 9, further comprising a fastener rotatable about a fastener axis, wherein the fastener extends through the second leg such that rotation of the fastener about the fastener axis moves the retainer in the direction toward the housing and the flange to inhibit movement of the housing relative to the flange.

11. A light fixture comprising:

a light source having an optical axis;

a housing having an inner housing and an outer housing, the outer housing pivots relative to the inner housing, the light source coupled to the outer housing for pivotal movement with the outer housing relative to the inner housing to move the optical axis relative to the inner housing;

a retainer coupled to the housing, a portion of the retainer movable in a direction toward the outer housing to inhibit movement of the outer housing relative to the inner housing to hold a position of the optical axis.

12. The light fixture of claim 11, further comprising an actuator coupled to the retainer, wherein the actuator moves the retainer in the direction toward the outer housing to inhibit movement of the outer housing relative to the inner housing.

13. The light fixture of claim 12, wherein the actuator includes a fastener rotatable about a fastener axis to move the retainer in the direction toward the outer housing to inhibit movement of the outer housing relative to the inner housing.

14. The light fixture of claim 13, wherein the light fixture includes only a single fastener needed to move the retainer in the direction toward the outer housing to inhibit movement of the outer housing relative to the inner housing.

15. The light fixture of claim 13, further comprising a flange that extends from the housing, wherein the flange has a first side that faces away from the housing and a second side opposite the first side, the second side faces toward the housing, wherein the fastener is accessible for rotation from the first side of the flange.

16. The light fixture of claim 15, further comprising a trim removably coupled to the first side of the flange to conceal the fastener.

17. The light fixture of claim 11, wherein the retainer includes a ring that surrounds the outer housing.

18. The light fixture of claim 17, wherein the optical axis extends through the retainer.

19. The light fixture of claim 11, wherein the retainer includes a ring, a first leg that extends from the ring, and a second leg that extends from the ring, wherein the first leg is fixed from movement relative to the inner housing and the second leg is moveable relative to the inner housing to move the portion of the retainer that is movable in the direction toward the outer housing to inhibit movement of the outer housing relative to the inner housing.

20. The light fixture of claim 19, further comprising a fastener rotatable about a fastener axis, wherein the fastener extends through the second leg such that rotation of the fastener about the fastener axis moves the retainer in the direction toward the outer housing to inhibit movement of the outer housing relative to the inner housing.

* * * * *